US008651333B2

(12) United States Patent
Metropulos et al.

(10) Patent No.: US 8,651,333 B2
(45) Date of Patent: Feb. 18, 2014

(54) BEVERAGE DISPENSING ASSEMBLY

(75) Inventors: William Metropulos, McHenry, IL (US); Wayne Alpert, Crystal Lake, IL (US); Tim Knecht, Crystal Lake, IL (US)

(73) Assignee: Smart Bar USA LLC, Crystal Lake, IL (US)

( * ) Notice: Subject to any disclaimer, the term of this patent is extended or adjusted under 35 U.S.C. 154(b) by 0 days.

(21) Appl. No.: 13/165,403

(22) Filed: Jun. 21, 2011

(65) Prior Publication Data

US 2012/0152981 A1 Jun. 21, 2012

Related U.S. Application Data

(60) Provisional application No. 61/356,744, filed on Jun. 21, 2010.

(51) Int. Cl.
*B67D 7/74* (2010.01)

(52) U.S. Cl.
USPC ..... 222/129.1; 222/129.4; 222/144.5; 222/145.5; 222/145.6

(58) Field of Classification Search
USPC ..... 222/129.1, 129.4, 144.5, 146.6, 608, 222/135, 145.5, 145.6; 99/394, 391, 393, 99/392, 294; 366/209
See application file for complete search history.

(56) References Cited

U.S. PATENT DOCUMENTS

| | | | | |
|---|---|---|---|---|
| 535,082 | A * | 3/1895 | Kiriakies | 182/21 |
| 1,985,412 | A | 12/1934 | Jackson | |
| 2,876,806 | A | 3/1959 | Kirk et al. | |
| 3,592,367 | A | 7/1971 | Landis et al. | |
| 3,940,019 | A * | 2/1976 | Kross et al. | 222/30 |
| 4,162,028 | A | 7/1979 | Reichenberger | |
| 4,276,999 | A | 7/1981 | Reichenberger | |
| 4,392,588 | A * | 7/1983 | Scalera | 222/129.4 |
| 4,708,266 | A * | 11/1987 | Rudick | 222/105 |
| 4,974,500 | A | 12/1990 | Boyd et al. | |
| 5,129,551 | A | 7/1992 | Gott | |
| 5,350,082 | A | 9/1994 | Kiriakides et al. | |
| 5,731,981 | A | 3/1998 | Simard | |
| 6,135,009 | A | 10/2000 | Lassota | |
| 6,422,422 | B1 * | 7/2002 | Forbes | 222/66 |
| 7,267,247 | B1 | 9/2007 | Crunkleton et al. | |
| 7,806,294 | B2 * | 10/2010 | Gatipon et al. | 222/1 |
| 8,190,290 | B2 * | 5/2012 | Crisp, III | 700/236 |
| 2005/0115989 | A1 | 6/2005 | Ludovissie et al. | |
| 2006/0118581 | A1 * | 6/2006 | Clark | 222/333 |
| 2006/0138170 | A1 * | 6/2006 | Brim et al. | 222/129.1 |
| 2007/0114244 | A1 | 5/2007 | Gatipon et al. | |
| 2010/0116842 | A1 * | 5/2010 | Hecht et al. | 222/1 |
| 2011/0017776 | A1 * | 1/2011 | Metropulos et al. | 222/129.1 |
| 2011/0259918 | A1 * | 10/2011 | Meeuwisse | 222/135 |
| 2012/0055954 | A1 * | 3/2012 | Hecht | 222/129.1 |

* cited by examiner

*Primary Examiner* — Frederick C Nicolas
*Assistant Examiner* — Bob Zadeh
(74) *Attorney, Agent, or Firm* — McDermott Will & Emery LLP

(57) ABSTRACT

The present invention is directed a beverage dispensing machine and beverage dispenser that may be used for mixing and dispensing liquids. The beverage dispenser has a mounting bracket with a carrier that is removably connected to the mounting bracket and a mixing bowl that is removably connected to the carrier. The beverage container also has a first set of fittings extending from the mounting bracket for receiving a first set of liquids and dispensing the first set of liquids into the mixing bowl. The beverage container also has a second set of fittings also extending from the mounting bracket for receiving a second set of liquids and dispensing the second set of liquids into the mixing bowl.

19 Claims, 8 Drawing Sheets

BEVERAGE DISPENSING ASSEMBLY

CROSS-REFERENCE TO RELATED APPLICATIONS

This application claims the benefit of U.S. Provisional Application No. 61/356,744 filed Jun. 21, 2010, which is expressly incorporated herein by reference.

FEDERALLY SPONSORED RESEARCH OR DEVELOPMENT

Not Applicable.

TECHNICAL FIELD

The present invention relates generally to a beverage dispenser, and more specifically to a beverage dispensing assembly for dispensing mixed beverages.

BACKGROUND OF THE INVENTION

Beverage dispensers are well known in the art. While such dispensers according to the prior art provide a number of advantages, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention generally provides a beverage dispenser that may be used for mixing and dispensing liquids. In one embodiment, the beverage dispenser includes a mounting bracket with a carrier that may be removably connected to the mounting bracket and a mixing bowl that may be removably connected to the carrier. In another embodiment, the beverage dispenser may also include a first set of fittings connected to the mounting bracket for receiving a first set of liquids and dispensing the first set of liquids into the mixing bowl. In another embodiment, the beverage dispenser may include a second set of fittings also extending from the mounting bracket for receiving a second set of liquids and dispensing the second set of liquids into the beverage container. In yet another embodiment, the mounting bracket of the beverage dispenser includes an upper dispensing plate and a lower dispensing plate. The upper dispensing plate may include a cavity which may include a series of ports extending therefrom, the cavity connectible to a third set of liquids.

Other features and advantages of the invention will be apparent from the following specification taken in conjunction with the following drawings.

BRIEF DESCRIPTION OF THE DRAWINGS

To understand the present invention, it will now be described by way of example only, not by way of limitation, with reference to the accompanying drawings in which.

DETAILED DESCRIPTION

Figure 1:
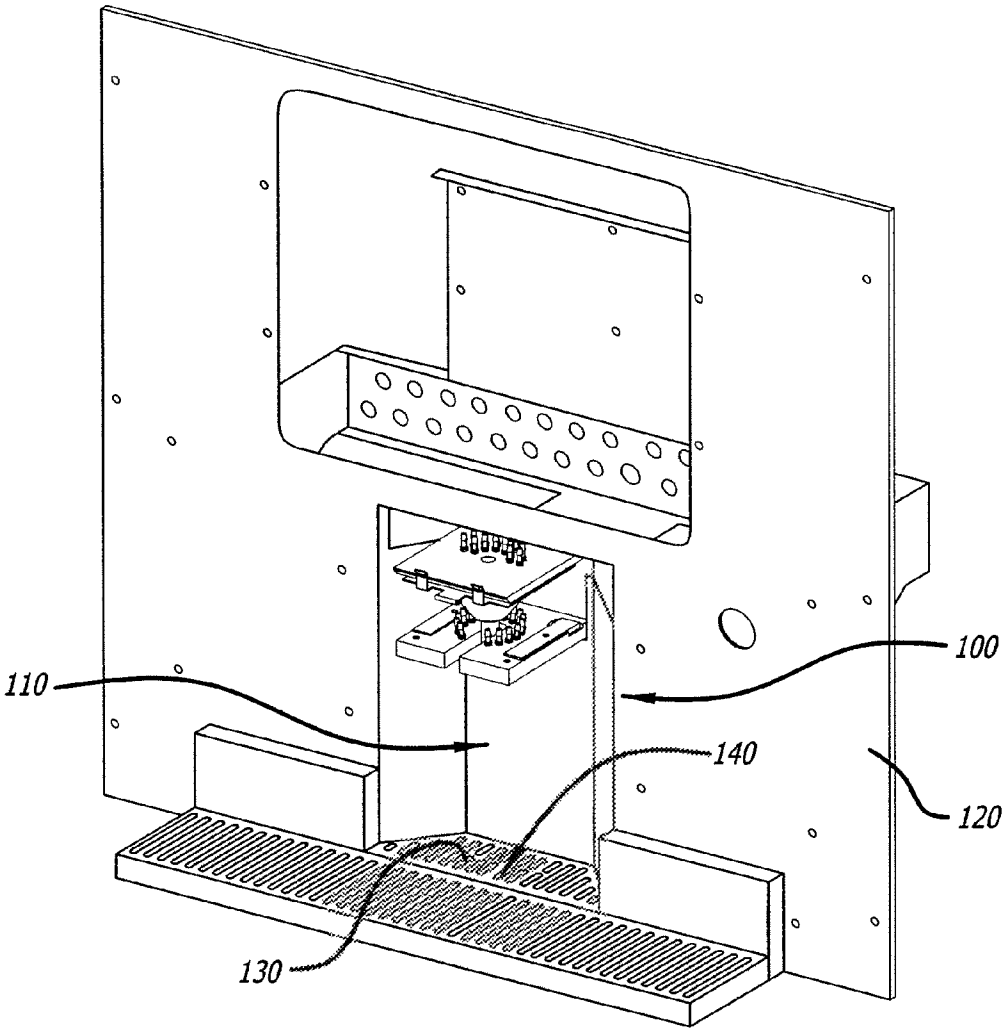
FIG. 1 is a perspective view of one example of the beverage dispensing assembly shown in its environment of use.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The various examples disclosed herein relate to systems, methods, and equipment that may be used to create and dispense mixed beverages.

Referring now to the figures, and specifically to FIG. 1, there is shown a beverage dispensing assembly 100 in its partial environment of use. The beverage dispensing assembly 100 is fixed above an open cavity 110 of a housing 120 of the beverage dispensing machine and is located above a platform 130 covering a reservoir 140. The distance between the beverage dispensing assembly 100 and the platform 130 is sufficiently large to allow a beverage container, such as a cup, to be placed upon the platform 130 and underneath the beverage dispensing assembly 100 for dispensing a beverage from the beverage dispensing assembly 100 into a beverage container. The beverage dispensing assembly 100 is connected to a plurality of beverage ingredients through a plurality of tubes (not shown), as discussed in detail herein. In a preferred embodiment the beverage dispensing assembly 100 generally comprises a dispensing mechanism for dispensing mixers, a mixing bowl for mixing the mixers (typically with a carbonated water) prior to the mixers being dispensed into the waiting beverage container, and a dispensing mechanism for dispensing an alcohol into the waiting beverage container.

Figure 2:
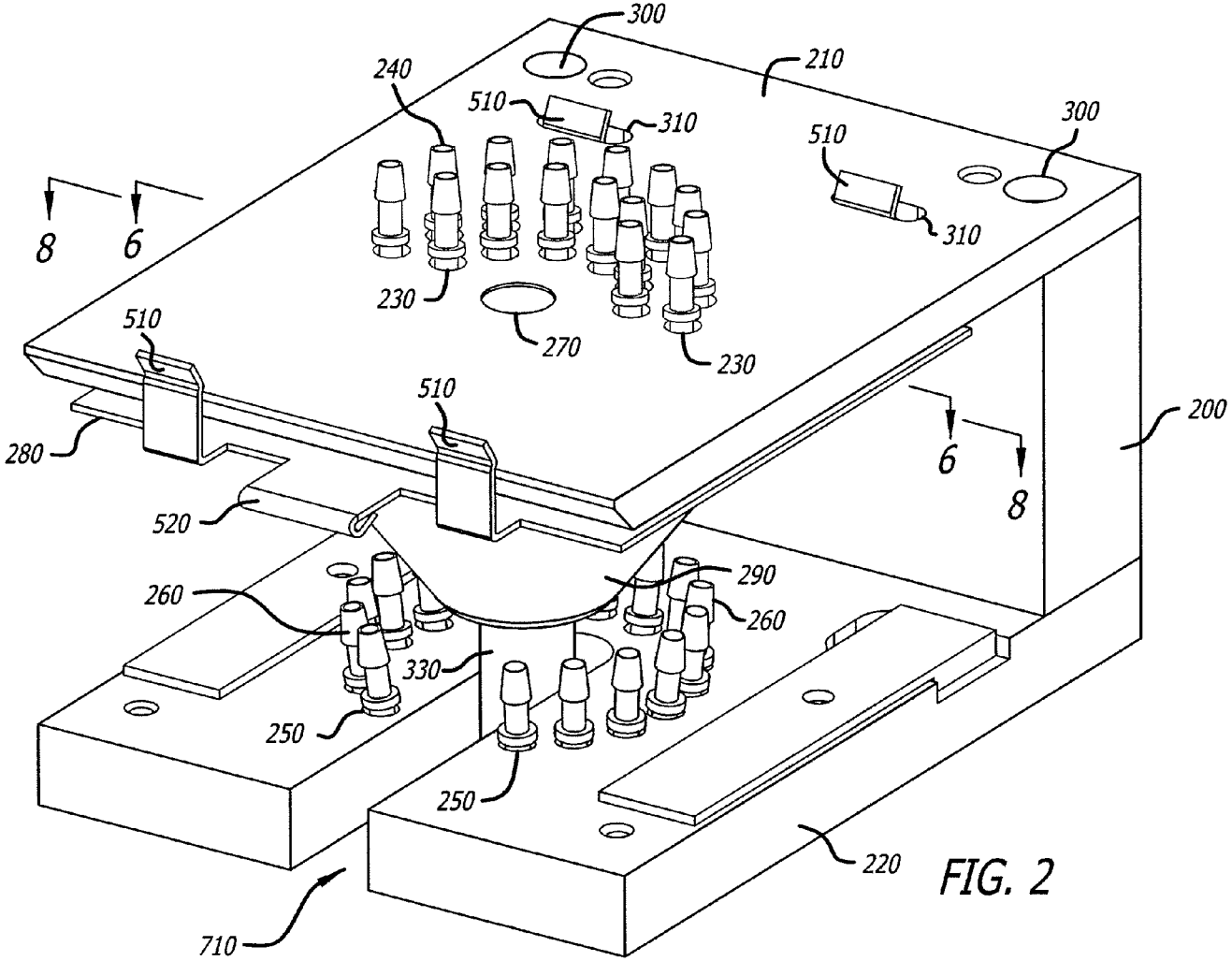
FIG. 2 is a perspective view of one example of the beverage dispensing assembly.

As shown in FIG. 2, in one embodiment the beverage dispensing assembly 100 has a mounting bracket comprised of a mounting plate 200, an upper dispensing plate 210 and lower dispensing plate 220. In one embodiment, the upper dispensing plate 210 and the lower dispensing plate 220 are mounted perpendicularly to the mounting plate 200 and parallel to each other. Mounting plate 200 fixedly connects upper dispensing plate 210 and lower dispensing plate 220 in spaced relation.

Figure 3:
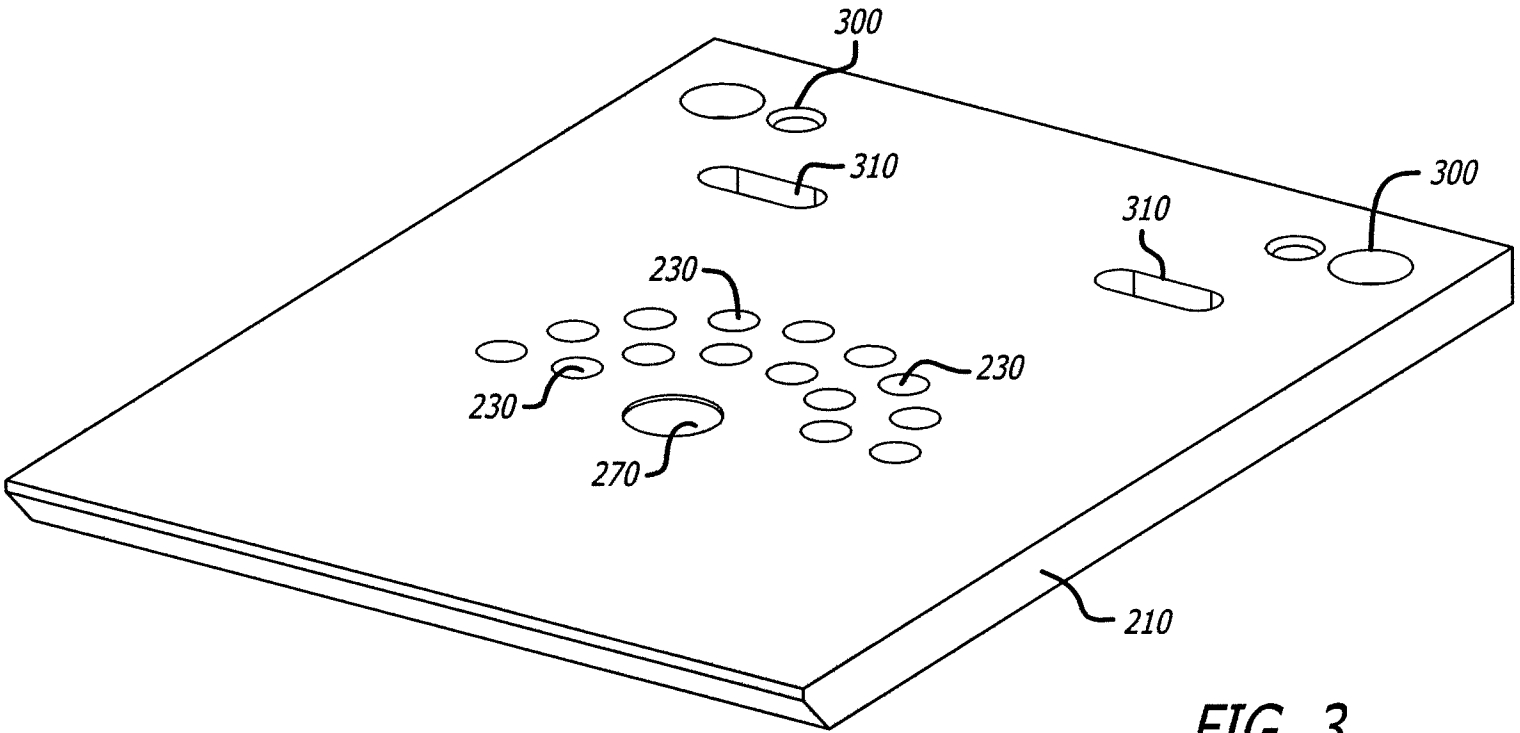
FIG. 3 is a perspective view of the top of the upper dispensing plate of the beverage dispensing assembly of FIG. 2, showing the upper dispensing plate without fittings and without the attachments to other portions of the beverage dispensing assembly.

As shown in FIG. 3, the upper dispensing plate 210 has a plurality of fitting apertures 230 for holding a first set of fittings 240, and the lower dispensing plate 220 has another plurality of fitting apertures 250 (see FIGS. 2, 7 and 8) for holding a second set of fittings 260. The fittings 240 and 260 are preferably connected to tubing (not shown) which is connected to a variety of beverage supplies. The beverage supplies may comprise beverages and beverage components in bags, boxes, bottles, bag-in-boxes, or other beverage containers that contain the beverage ingredients that the beverage dispensing assembly 10 will draw from to make mixed beverages. In some examples, the beverage ingredients connected to the first fittings 240 are provided from a first set of ingredients, such as mixing ingredients, that may include juice, soft drink syrup, tonic, cocktail mixers, or other types of non-alcoholic ingredients, while the beverage ingredients connected to the second fittings 260 are provided from a second set of ingredients that may include a variety of alcoholic ingredients, such as rum, gin, vodka, whiskey, tequila, etc. The upper dispensing plate 210 also has a larger dispensing cavity 270 used to connect another liquid, such as a water supply (not shown), to the beverage dispensing assembly 100 for mixing the liquid, including carbonated water, with the mixing ingredients. In a preferred embodiment, there are fifteen fitting apertures 230 in the upper dispensing plate 210 positioned arcuately above the mixing bowl 290, and sixteen fitting apertures 250 in the lower dispensing plate 220 positioned arcuately around the beverage container.

The mounting plate 200, upper dispensing plate 210, and lower dispensing plate 220 of the mounting bracket may be constructed out of plastic, metal, aluminum, or any other suitable material. In one embodiment the upper dispensing plate 210 and lower dispensing plate 220 are attached to the mounting plate 200 via fasteners, such as nails, screws, or bolts. The fasteners extend through mounting apertures 300 in the upper dispensing plate 210 and lower dispensing plate 220, respectively, and are secured to the mounting plate 200. Alternately, the mounting plate 200, upper dispensing plate 210 and lower dispensing plate 220 of the mounting bracket may be connected via welding or with the use of an adhesive. Further yet, in another alternate embodiment the mounting plate 200, upper dispensing plate 210, and lower dispensing 220 may be constructed or molded from a single piece of material.

Figure 4:
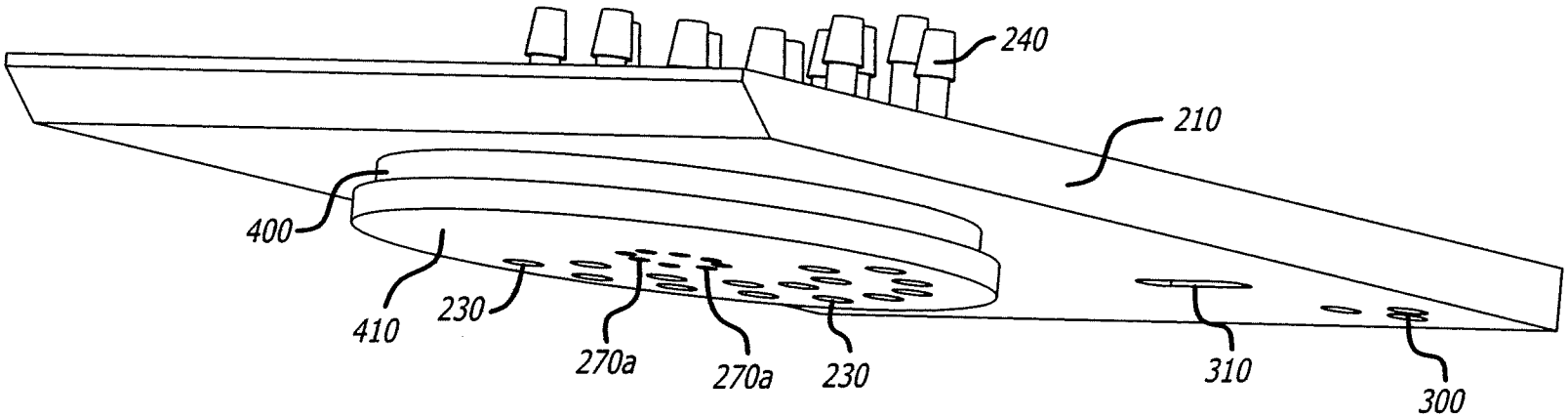
FIG. 4 is a perspective view of the bottom of the upper dispensing plate of the beverage dispensing assembly of FIG. 2, the view showing the condition where fittings are attached to the upper dispensing plate.
Figure 5:
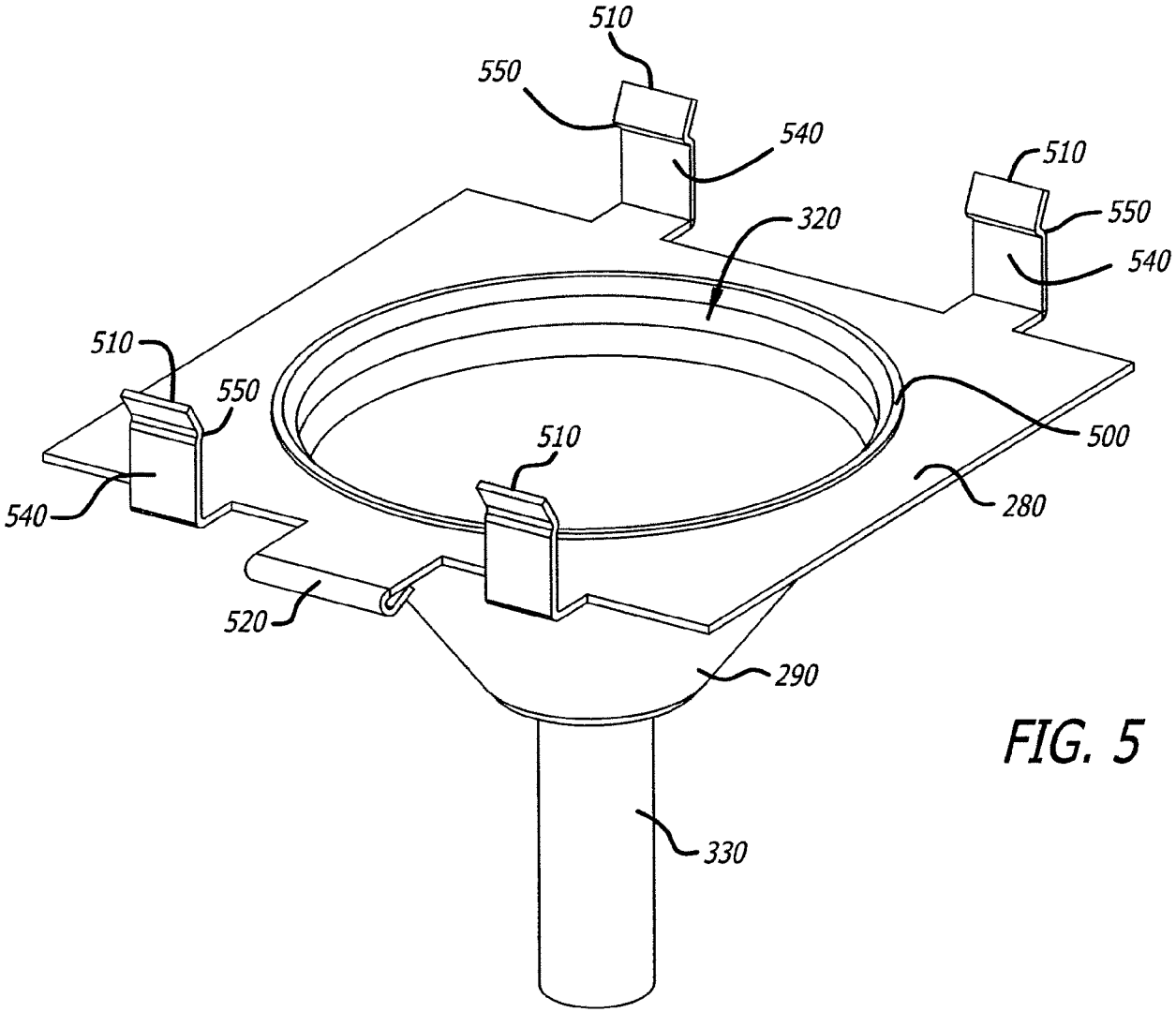
FIG. 5 is a perspective view of the carrier and mixing bowl of the beverage dispensing assembly of FIG. 2.

Referring to FIGS. 2 and 5, one embodiment of the beverage dispensing assembly 100 also comprises a carrier 280 that supports a mixing bowl 290 for mixing some of the beverage ingredients. In one embodiment the carrier 280 is attached to the upper dispensing plate 210. In such an embodiment, a portion of the mixing bowl 290 may be positioned between the upper dispensing plate 210 and lower dispensing plate 220 while another portion may extend below the lower dispensing plate 220 as shown in FIG. 2. As shown in FIGS. 3 and 4, in one embodiment the upper dispensing plate 210 also has clipping apertures 310 that are used to allow the carrier 280 to be connected to the upper dispensing plate 210, as further discussed herein.

Figure 6:
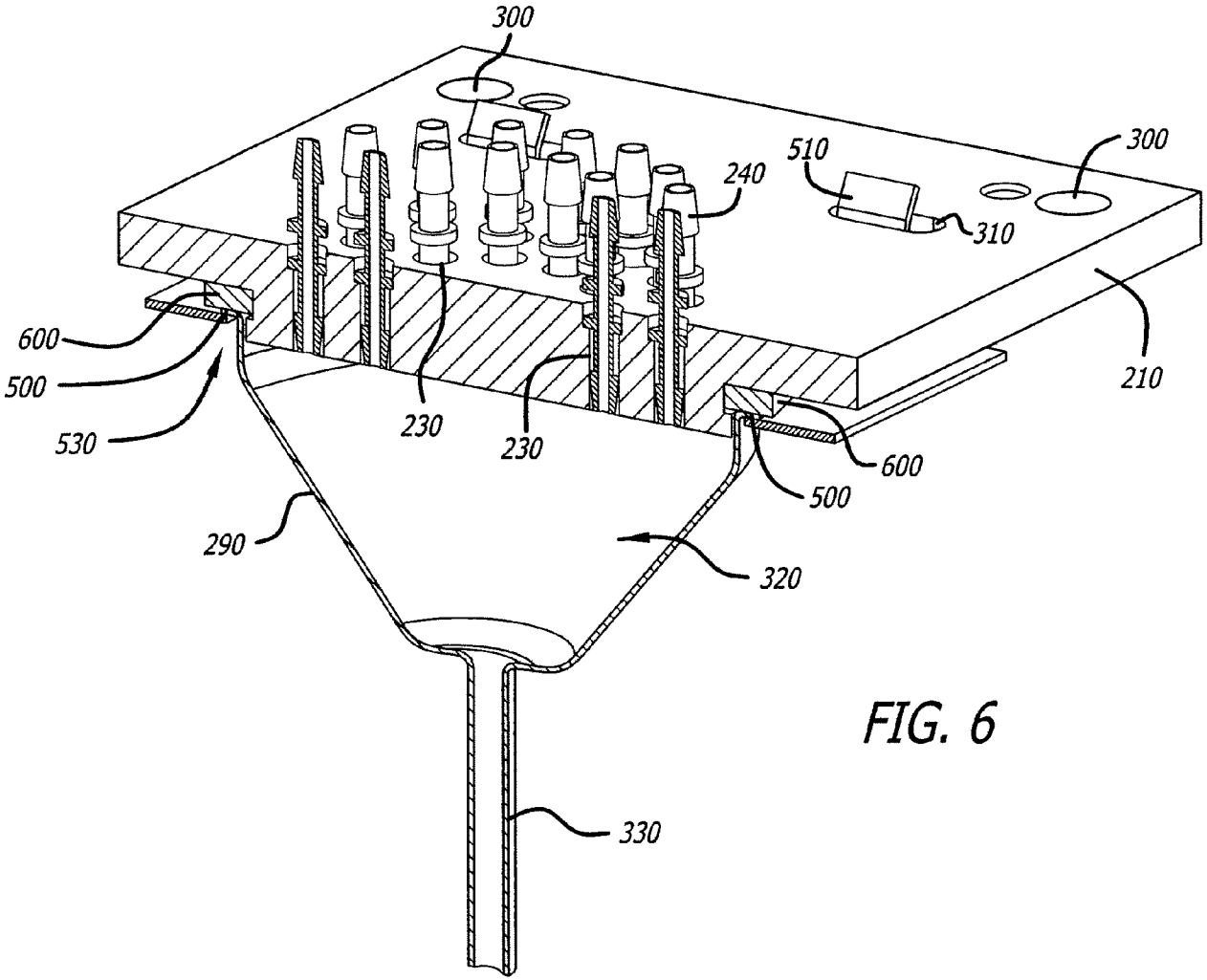
FIG. 6 is a cross-sectional view of the upper dispensing plate, carrier, and mixing bowl taken through line 6-6 of the beverage dispensing assembly of FIG. 2.

As best shown in FIG. 6, in one embodiment each fitting 240 is connected to the mounting plate 210 and extends at least partially through the upper dispensing plate 210 via fitting aperture 230. The fitting apertures 230 and the fittings 240 extend generally parallel to a longitudinal axis of the mixing bowl 290 such that the fittings 240 may direct beverage ingredients into the inner periphery 315 of the mixing bowl 290. The fittings 240 may also extend generally perpendicularly to the plane of the upper dispensing assembly 210. Accordingly, as shown in FIG. 2, the beverage ingredients are mixed in a bowl portion 320 of mixing bowl 290. The particular relational configuration of the fitting apertures 230 and mixing bowl 290, shown in FIGS. 2 and 3, ensures that each beverage ingredient dispensed through the fitting apertures 230 will make contact with the bowl portion 320 of mixing bowl 290 for proper mixing before traveling through a stem portion 330 of the mixing bowl 290 and being dispensed into a waiting beverage container. In this configuration, the fittings 240 are also perpendicular to horizontal cross-section of the mixing bowl. When the beverage ingredients are dispensed into the mixing bowl 290, centrifugal force creates a whirlpool effect to mix the beverage ingredients prior to dispensing them into the beverage container. The number of apertures 230 and the configuration thereof may vary depending on a variety of factors. These factors may include the number of beverage ingredients used to create the mixed beverages, the size of the fittings, the shape of the fittings, and or the size and shape of the mixing bowl 290.

Figure 8:
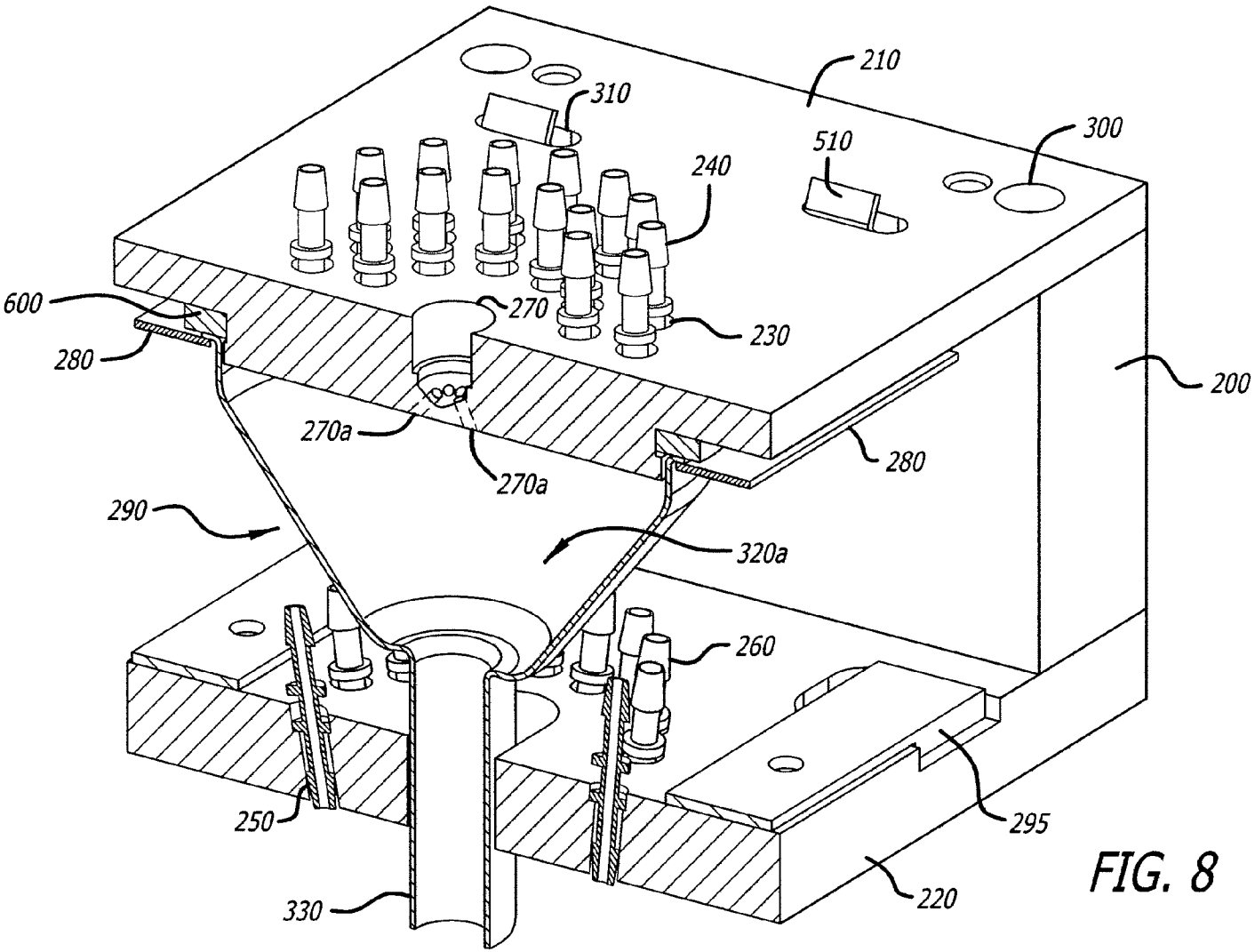
FIG. 8 is a cross-sectional view taken through line 8-8 of the beverage dispensing assembly of FIG. 2.

Returning to FIG. 3, the upper dispensing plate 210 also contains a dispensing cavity 270 for connecting the beverage dispensing assembly 100 to another liquid such as a water supply. In one embodiment, the opening to the dispensing cavity 270 has a diameter greater than the diameter of fitting apertures 230. In such an embodiment it is centered over the mixing bowl and partially bordered by the plurality of fitting apertures 230. The water supplied through dispensing cavity 270 may be tap, filtered, carbonated, or any combination thereof. As shown in FIG. 4, illustrating the bottom surface of the upper dispensing plate 210, and as shown in FIG. 8, illustrating a cross-section of the upper dispensing plate 210, the exit to the dispensing cavity 270 comprises a plurality of separate angularly disposed ports 270*a*. Referring to FIG. 8, in a preferred embodiment the separate ports 270*a* may be directed at an outward angle to a centerline of the beverage dispensing assembly 100 such that the water is directed outwardly toward the bowl portion 320 of mixing bowl 290. The outwardly directed angle of the plurality of dispensing ports 270*a* ensures that the water is dispersed throughout the mixing bowl 290. This configuration also ensures that the water, dispensed through the dispensing aperture ports 270*a*, mixes with the other beverage ingredients, dispensed through the fitting apertures 230, in the mixing bowl prior to the water and beverage ingredients being dispensed into the waiting beverage container. Additionally, the separate dispensing of water through the plurality of outwardly angled ports 270*a* following the dispensing of the requested beverage may also provide to clean the inner surface of the mixing bowl 290 between beverage dispenses. In such a manner residual amounts of a dispensed beverage ingredient are removed from the inner surface of the mixing bowl 290 to prevent unwanted cross-mixing of beverage ingredients.

Also shown in FIG. 4, the bottom surface of upper dispensing plate 210 has a projection 410 extending therefrom. Preferably, the geometrical configuration of the projection 410 is designed to mate with the geometrical configuration of the opening to the mixing bowl 290. Accordingly, in a preferred embodiment illustrated in FIG. 4, the projection 410 is cylindrically shaped to mate with the cylindrical opening to the bowl portion 320 of the mixing bowl 290. In such an embodiment the diameter of projection 410 is smaller than the inner diameter of the mixing bowl 290 such that projection 410 extends into the interior region of the opening to bowl portion 320 of mixing bowl 290. This ensures that all beverage ingredients dispensed from the first fittings 240 are dispensed into the interior of the mixing bowl 290. Projection 410 also comprises an undercut 400. Undercut 400 of the projection 410 is provided to allow for placement and retention of a gasket 600 (shown in FIG. 6). As shown in FIG. 6, the gasket 600 is thus located between the upper dispensing plate 210 and the mixing bowl 290 in order to form a substantially fluid tight seal. The gasket 600 may be made out of any rubber, plastic or other sealant type material such that the it creates a substantially fluid tight seal between the upper dispensing plate 210 and mixing bowl 290.

Figure 7:
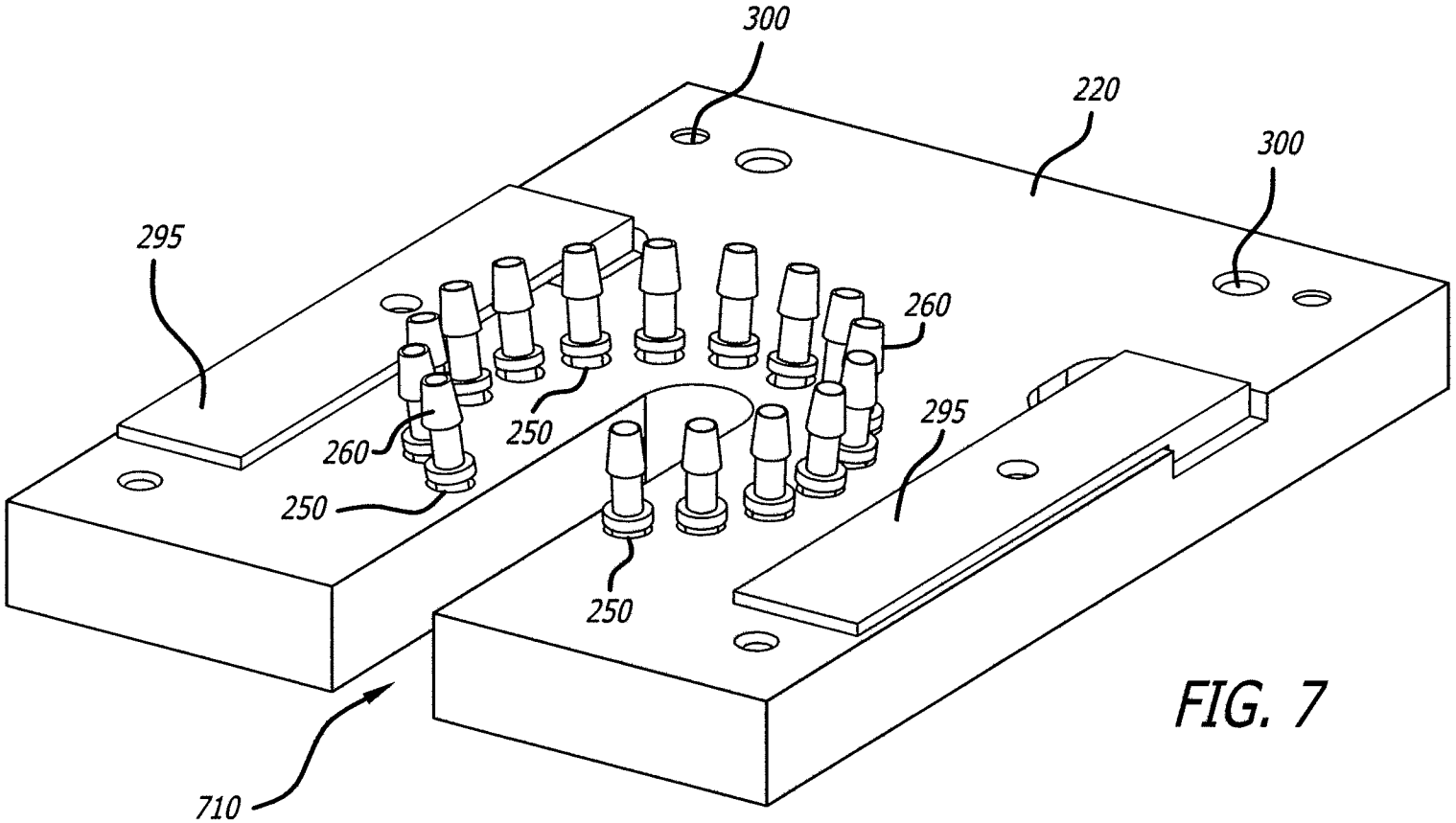
FIG. 7 is a perspective view of the top of the lower dispensing plate of the beverage dispensing assembly of FIG. 2.

Referring now to FIG. 7, there is shown a top perspective view of one embodiment of the lower dispensing plate 220.

The lower dispensing plate 220 has apertures 700 for holding fasteners to attach the lower dispensing plate 220 to the mounting plate 200. Lower dispensing plate 220 also has a plurality of apertures 250 for the placing of fittings 260 and an opening 710 sufficiently large to allow the stem portion 330 of the mixing bowl 290 to extend through lower dispensing plate 220. In the current embodiment, the apertures 250 connect the fittings 260 to the lower dispensing plate 220 and allow fittings 260 to extend partially therethrough. The apertures 250 and fittings 240 are configured in an arcuate design and are positioned generally tangentially with respect to the plane of the lower dispensing plate 220 and at an angle relative to the lower dispensing plate 220. In this angled design, the fittings 260 dispense the beverage ingredients toward the center of the beverage container. This angled design allows the fittings 260 to dispense the beverage ingredients into the center of a beverage container. Such an arrangement increases the chances that the liquid dispensed through the apertures 250 is placed within the beverage container and is not dispensed outside the beverage container. This configuration also allows for better mixing with the beverage ingredients dispensed from stem 330 of the mixing bowl 290. The fittings 260 are generally connected to tubes (not shown) that are fluidly connected to a plurality of beverage supplies. In the current embodiment, the fittings 260 are connected to a supply of alcoholic beverage ingredients but it should be apparent to one of ordinary skill that any beverage ingredient may suffice. In one embodiment the lower dispensing plate 220 has sixteen apertures 250/fitting 260 combinations, however, it is understood that a greater or lesser number of aperture/fitting combinations may be present. For example, in an alternate embodiment the dispensing plate has thirty-two apertures/fittings for dispensing alcoholic beverages. In such an alternate embodiment a first arcuate arrangement of apertures/fittings is provided, and a second arcuate arrangement of apertures/fittings is also provided and located concentric to the first arcuate arrangement.

The lower dispensing plate 220 also contains plates 295 which cover a variety of electronic components and circuitry, and protect these components from liquids used in the beverage dispensing assembly. In one embodiment, the plates cover LED lights that emit light downwardly from the beverage dispensing assembly 100 toward the open cavity 110 of the housing 120 of the beverage dispensing machine so that when a beverage container is placed in position to receive a beverage the area is lit.

As shown in FIG. 2, the lower dispensing plate 220 also has an opening 710 through which the stem 330 of the mixing bowl 290 extends to allow the liquid to be dispensed from the mixing bowl 290 into a beverage container. In a preferred embodiment, the opening 710 comprises a recess extending from the front edge of the lower dispensing plate 220. This preferred structure also allows the carrier 280 and mixing bowl 290 to be more easily removed from the beverage dispensing assembly 100 for cleaning and the like.

As shown in FIG. 5, in one embodiment the carrier 280 retains the mixing bowl 290. In a preferred embodiment the mixing bowl 290 has a funnel-like shape with a bowl portion 320 and stem portion 330. Mixing bowl 290 also has a flange 500 that extends from a circumference of the opening to the bowl portion 320 of the mixing bowl 290. Additionally, in one embodiment the carrier 280 has an opening 530 which is designed to allow the mixing bowl 290 to pass through a portion of the carrier 280. In a preferred embodiment, the opening 530 in the carrier 280 is circular to match with the circular geometry of the mixing bowl 290. In such embodiment, as shown in FIG. 6, the opening 530 has a diameter which is larger than the outer diameter of the bowl portion 320 of the mixing bowl 290, but which is also smaller than the circumference of the outer edge of the flange 500 of the mixing bowl 290, such that the flange 500 rests on the upper surface of the carrier 280, suspending the bowl portion 320 and stem portion 330 of the mixing bowl 290 below the carrier 280.

Also shown in FIG. 5, the carrier 280 also has a plurality of clip members 510 extending therefrom. The clip members 510 are used for removably retaining the carrier 280 and mixing bowl 290 to the upper dispensing plate 210. In one embodiment the clip members 510 are spring members that have a leg 540 and a transition 550 at the end of the leg 540. As shown in FIG. 2, the rear clip members 510 extend through the clip apertures 310 in the upper dispensing plate 210 and the transition 550 rests on the upper surface of the upper dispensing plate 210. Similarly, the transitions 550 on the front clip members 510 of the carrier 280 rest on the upper surface of the upper dispensing plate 210, thereby fixedly, but removably, securing the carrier 280 and mixing bowl 290 to the upper dispensing plate 210. In a preferred embodiment, the carrier 280 is removable from the upper dispensing plate 210 to allow for the removal of mixing bowl 290 for cleaning, replacing, or other purposes. To release carrier 280 from the upper dispensing plate 210, one would apply a release force to the front clip members 510 to release the transitions 550 from engagement with the upper dispensing plate 210 such that the front clip members 510 will unclip from the upper dispensing plate 210. Although in the current example the carrier 280 includes flexible clip members 510 to attach and retain the carrier 280 to the upper dispensing plate 210, one of ordinary skill will recognize that the carrier 280 may be removably fixed to upper dispensing tray 210 using a variety of fasteners and materials without straying from the scope of the current design. Such carriers may use such fasteners as snaps, hinges, or latches and be made out of metal or other plastic material or any combination thereof.

The carrier 280 also has a tab 520 which the user can retain to further manipulate the carrier 280 once the front clip members 510 are released from the upper dispensing plate 210 and to assist the user in removing the rear clip members 510 from the clip apertures 310. In one embodiment the carrier 280 is made out of stainless steal, including a stainless spring steel, however, in alternate embodiments the mixing bowl 290 may be made out of other suitable materials such as other metals, plastic, etc. and any combination thereof. Similarly, in one embodiment, the mixing bowl 290 is made from stainless steel, however, alternate materials, such as other metals, plastic, glass, etc., and any combination thereof, may be utilized.

In order to fully understand the arrangement of the components described above, FIG. 6 is provided and illustrates a cross-sectional view, taken through line 6-6 of FIG. 2, of the upper dispensing plate 210 (including the apertures 230 and fittings 240), carrier 280, mixing bowl 290 and gasket 600. As shown in FIG. 6, the mixing bowl 290 extends through the opening 530 in the carrier 280, and the flange 500 extending from the circumference of the opening to the mixing bowl 290 engages the carrier 280. Additionally, the gasket 600 that surrounds the undercut portion 400 of projection 410. When the carrier 280 and mixing bowl 290 are connected to the upper dispensing plate 210, the projection 410 of upper dispensing plate 210 enters the inner cavity of the bowl portion 320 of mixing bowl 290. Additionally, when the projection 410 is seated within the inner cavity of the mixing bowl 290 the gasket 600 connected to the periphery of the projection 410 engages the flange 500 of the mixing bowl 290 to form a substantially fluid tight seal between the upper dispensing plate 210 and the mixing bowl 290. In this orientation the apertures 230 and fittings 240 are configured to ensure that all beverage ingredients dispensed from fittings 240 are directed into the mixing bowl 290 and mixed therein as they travel through the bowl portion 320 prior to exiting the mixing bowl 290 through stem 330.

Referring now to FIG. 8, there is shown an embodiment of the beverage dispensing assembly 100 in cross section. In this embodiment, the first set of beverage ingredients is drawn via tubes connected to the beverage ingredient storage containers. The tubes are connected to fittings 240 and the mixer beverage ingredient is dispensed therethrough into the bowl portion 320 of mixing bowl 290.

Upon entering the bowl portion 320 of mixing bowl 290, the beverage ingredients are mixed together. Generally, syrup-type ingredients are fed through the fittings 240 and apertures 230 and mixed with carbonated water that is fed through the water cavity 270. The beverage ingredients mix as they travel through mixing bowl 290, and ultimately exit through the stem portion 330 where they are provided to a beverage container placed below the stem portion 330. The specific beverage ingredient from the first set of beverage ingredients that is dispensed is dependent upon user input.

A beverage ingredient from the second set of ingredients, typically a beverage containing alcohol, is dispensed into the beverage container via fittings 260 and apertures 250. The fittings 260 are connected to the second set of beverage ingredients via a set of tubes. The specific beverage ingredient from the second set of beverage ingredients that is dispensed is dependent upon user input. As shown in FIG. 8, the apertures 250 that hold the fittings 260 are angled inward such that the beverage ingredient from the second set of beverage ingredients is dispensed into the cup at an angle toward the center of the cup. Since the first set of ingredients are dispensed into the mixing bowl 290 while the second set of ingredients is dispensed directly into the cup, the first set of ingredients and second set of ingredients are not mixed until they are combined in the cup. This configuration allows for the creation of non-alcoholic mixed drinks Further the possibility of unintentionally providing an alcoholic beverage is reduced since the only way for alcohol to get into the cup is by being dispensed directly in the cup. Additionally, the likelihood of contamination of a nonalcoholic drink is reduced as the interior of the mixing bowl 290 never has residual alcohol left in it from making a previous alcoholic beverage.

One of ordinary skill will recognize that the order in which the beverage ingredients are dispensed is of no consequence to the current design. A beverage ingredient may be dispensed from the second set of beverage ingredients prior to being dispensed from the first set of ingredients, during dispensing of the first ingredient or following dispensing of the first ingredient.

In some examples, to further avoid contamination of a mixed beverage by residual amounts of the previously dispensed mixed beverage, the mixing bowl 290 may be cleaned using water dispensed from the water supply via the dispensing cavity 270. The water is dispensed after each mixed beverage is created, and after the beverage container has been removed, so that the mixing bowl 290 may be washed of any residual ingredients left in the mixing bowl 290. The dispensing cavity 270 has dispensing aperture ports 270*a* that are angled through the upper dispensing plate 210 at outward angles. This allows for the water to make contact with all portions of the mixing bowl 290. The water as well as any residual ingredients are dispensed out of stem portion 330 of mixing bowl 290.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A beverage dispenser for mixing and dispensing liquids, comprising:

a mounting bracket;

a carrier connected to the mounting bracket;

a mixing bowl removably connected to the carrier;

a first set of fittings connected to the mounting bracket for receiving a first set of liquids and for dispensing the first set of liquids into the mixing bowl; and, a second set of fittings connected to the mounting bracket for receiving a second set of liquids and for dispensing the second set of liquids directly into a beverage container and bypassing the mixing bowl.

2. The beverage dispenser for mixing and dispensing liquids of claim 1, wherein the first set of fittings extend generally parallel to a longitudinal axis of the mixing bowl, and are arcuately positioned above a portion of the mixing bowl.

3. The beverage dispenser for mixing and dispensing liquids of claim 1, wherein the second set of fittings extend at an angle relative to the plane of the mounting bracket and are positioned arcuately about the periphery of the mixing bowl.

4. The beverage dispenser for mixing and dispensing liquids of claim 1, wherein the mixing bowl contains a bowl portion, and a stem portion extending from the bowl portion, the stem portion dispensing the first set of liquids into the beverage container.

5. The beverage dispenser for mixing and dispensing liquids of claim 1, wherein the mounting bracket comprises an upper dispensing plate and a lower dispensing plate, the first set of fittings connected to the upper dispensing plate and the second set of fittings connected to the lower dispensing plate, and wherein a portion of the mixing bowl is positioned in the region therebetween.

6. The beverage dispenser for mixing and dispensing liquids of claim 5, wherein the carrier supports the mixing bowl from the upper dispensing plate.

7. The beverage dispenser for mixing and dispensing liquids of claim 5, wherein the lower dispensing plate contains an opening, and wherein a portion of mixing bowl extends therethrough.

8. The beverage dispenser for mixing and dispensing liquids of claim 1, wherein the mounting bracket contains a cavity located above the mixing bowl, wherein the cavity has a plurality of ports extending angularly therefrom, and wherein the cavity is connectable to a third set of liquids.

9. A beverage dispenser for mixing and dispensing liquids comprising:

a first set of fittings for receiving a first set of liquids and dispensing the first set of liquids;

a second set of fittings for receiving a second set of liquids and dispensing the second set of liquids; and a mixing bowl having a bowl portion and a stern portion extending from the bowl portion, wherein the mixing bowl receives the first set of liquids from the first set of fittings and dispenses them into a beverage container, and wherein the second set of fittings dispense the second set of liquids directly into the beverage container and bypassing the mixing bowl.

10. The beverage dispenser for mixing and dispensing liquids of claim 9, wherein the first set of fittings are arcuately positioned above the mixing bowl and are positioned generally parallel to a longitudinal axis of the mixing bowl.

11. The beverage dispenser for mixing and dispensing liquids of claim 9, wherein the second set of fittings are positioned arcuately about a periphery of the mixing bowl and at an angle relative to a longitudinal axis of the mixing bowl.

12. The beverage dispenser of claim 9, further comprising:

an upper dispensing plate having a first series of apertures to secure the first set of the fittings thereto;

a carrier attached to the upper dispensing plate, the carrier supporting the mixing bowl from the upper dispensing plate; and a lower dispensing plate located below the upper dispensing plate and a portion of the mixing bowl but above the beverage container, the lower dispensing plate having a second series of apertures to secure the second set of fittings thereto, and an opening wherein a portion of the mixing bowl extends therethrough.

13. The beverage dispenser of claim 12, further comprising a seal between a lower surface of the upper dispensing plate and the mixing bowl.

14. A beverage dispenser comprising:

a mounting bracket, a carrier removably connected to the mounting bracket, a mixing bowl removably connected to the carrier, a first set of fittings connected to the mounting bracket for receiving a first set of liquids;

and a second set of fittings connected to the mounting bracket for receiving a second set of liquids, wherein the first set of fittings dispense the first set of liquids into the mixing bowl, and wherein the second set of fittings dispense the second set of liquids directly into the beverage container and bypassing the mixing bowl.

15. The beverage dispenser of claim 14, wherein the first set of fittings extend generally parallel to a longitudinal axis of the mixing bowl, and are arcuately positioned above a portion of an inner periphery of the mixing bowl, and wherein the second set of fittings extend at an angle relative to the mounting bracket and are positioned arcuately about the periphery of the beverage container.

16. The beverage dispenser of claim 14, wherein the mixing bowl contains a bowl portion and a stem portion extending from the bowl portion, the stem portion dispensing the first set of liquids into the beverage container.

17. The beverage dispenser of claim 14, wherein the mounting bracket comprises an upper dispensing plate and a lower dispensing plate, the first set of fittings connected to the upper dispensing plate and the second set of fittings connected to the lower dispensing plate, and wherein a portion of the mixing bowl is positioned in the region therebetween.

18. The beverage dispenser of claim 17, further comprising a seal between a lower surface of the upper dispensing plate and the mixing bowl, wherein the carrier supports the mixing bowl from the upper dispensing plate.

19. The beverage dispenser of claim 14, wherein the mounting bracket contains a cavity located above the mixing bowl, wherein the cavity has a plurality of ports extending angularly therefrom, and wherein the cavity is connectable to a third set of liquids.

* * * * *